United States Patent [19]

Wright et al.

[11] 4,216,644

[45] Aug. 12, 1980

[54] OPEN END SPINNING ROTOR

[75] Inventors: Richard V. Wright; Robert E. Carter, both of Sanford, N.C.

[73] Assignee: Rogers Corporation, Rogers, Conn.

[21] Appl. No.: 958,537

[22] Filed: Nov. 7, 1978

[51] Int. Cl.[2] ..... D01H 1/12

[52] U.S. Cl. ..... 57/58.89

[58] Field of Search ..... 57/58.89

[56] References Cited

U.S. PATENT DOCUMENTS

| | | | |
|---|---|---|---|
| 3,439,487 | 4/1969 | Landwehrkamp et al. | 57/58.89 |
| 3,774,386 | 11/1973 | Kutscher et al. | 57/58.89 X |
| 3,958,403 | 5/1976 | Wehling | 57/58.89 |

FOREIGN PATENT DOCUMENTS

| | | | |
|---|---|---|---|
| 2148305 | 4/1973 | Fed. Rep. of Germany | 57/58.89 |
| 2239564 | 2/1974 | Fed. Rep. of Germany | 57/58.89 |
| 2358480 | 3/1978 | France | 57/58.89 |

*Primary Examiner*—Donald Watkins

*Attorney, Agent, or Firm*—Fishman and Van Kirk

[57] ABSTRACT

A spinning rotor for use in an open end spinning device for producing twisted yarns, the spinning rotor being symmetrical about a longitudinal axis and comprising a body machined from a unitary piece of self-lubricating plastic. The body includes a peripheral wall which defines an exterior surface which is cylindrical with respect to the longitudinal axis of the rotor. A reinforcing rim having the shape of a right circular cylinder and defining an internal cylindrical wall is positioned in abutment with the cylindrical exterior surface of the peripheral wall to reduce deformation of the body when the body is subjected to centrifugal forces.

5 Claims, 1 Drawing Figure

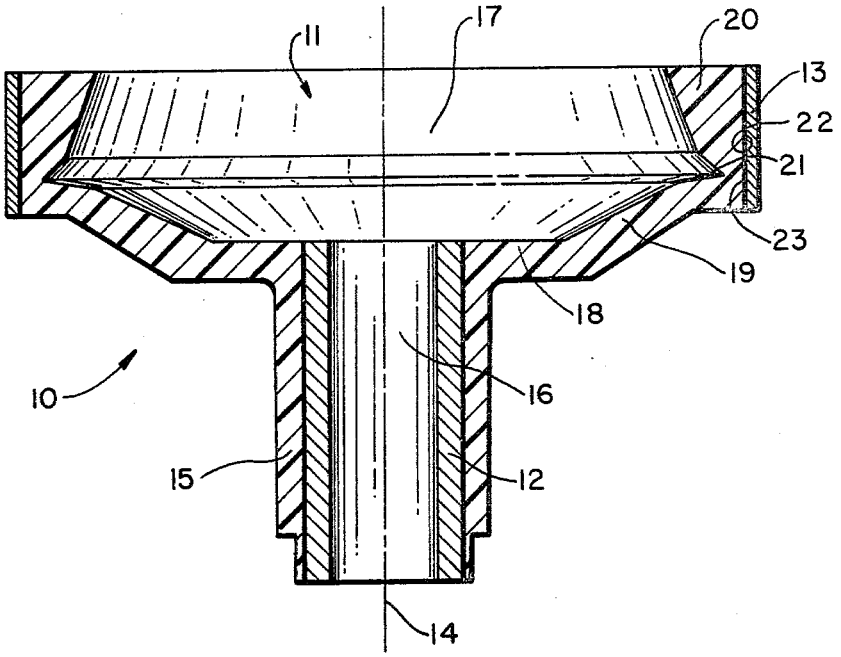
11
17
20
13
22
21
23
19
18
16
10
15
12
14

OPEN END SPINNING ROTOR

BACKGROUND OF THE INVENTION (1) Field of the Invention

The present invention relates to open end spinning rotors for spinning devices. More specifically, the present invention is directed to open end spinning rotors of the type which are rotated at relatively high speeds and are subjected to relatively high centrifugal forces.

(2) Description of the Prior Art

Spinning rotors used in open end spinning devices are rotated at relatively high speeds. Because of the relatively high rotational speeds, the peripheral wall of the rotor is subjected to tremendous centrifugal forces. Since the rotor must have sufficient strength to resist the centrifugal forces, prior art rotors are machined from a metal such as aluminum. It should be understood that it is relatively difficult to machine metal in comparison to plastic, and, further, metal is generally more expensive than plastic.

Because of the relatively high rotational speeds, a relatively large amount of friction is generated between the metal which bounds the fiber collection groove and the fibers which are collected in the groove. In order to reduce wear of the metal rotor and to increase the useful life of the rotor, a rotor is typically coated with a hard, wear resistant coating such as a ceramic coating, diamond coating or metal plating. It should be understood that this coating is costly to apply and also subject to damage such as chipping. Damage to the coating renders the rotor practically useless and the rotor must be replaced.

Because of the relatively heavy weight, metal rotors consume more power than a rotor having a lighter weight would consume. Also, due to the friction between the surface coating on the metal rotor and the fibers, the surface of the rotor tends to collect debris. It should be understood that the fibers which are drawn through the spinning rotor, whether natural or synthetic, may include additives which effect the properties of the yarn produced. The additives may be included, for example, to improve the luster of the yarn or to improve the strength properties of the yarn. During spinning of the fibers, debris may form on the surface of the rotor, the debris being the fiber additives and minute particles of fiber broken from the fibers. A small amount of debris will significantly effect the wear properties of the rotor.

It is an object of the present invention to provide a rotor which may be made, at least partially, of a plastic material. It is another object of the present invention to provide a rotor wherein the material which bounds the fiber collection groove generates reduced friction in comparison with metal. It is a further object of the present invention to provide a rotor which resists deformation as a result of centrifugal forces generated by rotation of the rotor at relatively high speeds.

SUMMARY OF THE PRESENT INVENTION

The open end spinning rotor of the present invention comprises a body which is machined from a self-lubricating plastic material, most preferably a lubricated acrylic plastic material having as the lubricant a dry graphite polysulfone lubricant. Such a plastic is sold under the trademark DELRIN. The body of the rotor is symmetrical about the longitudinal axis of the rotor and the exterior peripheral surface of the body has the shape of a right cylinder. The internal wall of the body defines a fiber collecting groove which is bounded by the lubricated plastic material to provide for reduced friction between the rotor and the fibers. Reduced friction results in less wear and in a longer useful life of the rotor in comparison with prior art metal rotors.

In order to prevent deformation of the peripheral walls of the rotor under the tremendous centrifugal force to which the rotor is subjected, a rim having the shape of a right cylindrical tube is fitted about the external cylindrical peripheral surface of the rotor body. It is essential that the peripheral exterior surface of the body be a right cylinder and that the shape of the rim be a right cylindrical tube so that the interior cylindrical surface of the rim firmly engages the cylindrical surface of the rotor body. The engagement of the rim with the body prevents deformation of the plastic peripheral wall of the rotor body due to centrifugal forces. Moreover, a rim having a right cylindrical tube shape has a reduced tendency to slip with respect to the peripheral surface of the body. If, for example, a rim having a shape other than a right cylindrical tube shape is used, a portion of the mass of the rim will be located at a different radius from the longitudinal axis of the rotor than another portion of the rim. When the rim turns, a differential centrifugal force will be exerted on the two masses and will cause the rim to slip with respect to the peripheral surface of the body. If the rim is separated from the body, the plastic will be allowed to relax and deform under the centrifugal force.

The rotor body also includes an elongated aperture which accommodates a metal bushing, the bushing having a generally cylindrical shape. The bushing receives a drive shaft which rotates the rotor. The bushing is made from a metal material which is softer than the shaft so that the bushing firmly engages the shaft. Typical materials for the bushing are brass and bronze while typical materials for the rim are aluminum and stainless steel.

BRIEF DESCRIPTION OF THE DRAWING

The FIGURE is a side sectional view of the rotor, the section being taken through the longitudinal axis of the rotor.

DETAILED DESCRIPTION OF THE INVENTION

Referring to the FIGURE, rotor 10 comprises the plastic rotor body 11, a metal bushing 12 and a rim 13. The parts of rotor 10 are symmetrical about the longitudinal axis 14 of the rotor. The body 12 includes an elongated cylindrical portion 15 which defines an elongated hole which receives bushing 12 and a shaft for driving a rotor, the shaft not being shown in the drawings. The rotor body flares radially outwardly from the top of cylindrical portion 15, and upwardly to form a fiber collection bowl 17. From the top of the cylindrical portion 15, the plastic rotor body flares radially outwardly to form a wall 18 which is transverse to longitudinal axis 14. The body then flares radially outwardly and upwardly to form inclined wall 19 and then flares radially inwardly and upwardly to form second inclined wall 20. At the junction between walls 19 and 20, a fiber collection groove 21 is formed, the fiber collection groove 21 having a "V" shaped configuration. However, it should be understood that there exists many different fiber collection bowl designs and that the present invention is not limited to any particular fiber bowl design.

The body 11 includes a peripheral surface 22. It is an essential feature of the present invention that peripheral surface 22 be cylindrical with respect to longitudinal axis 14. It should be understood that the wall 20 of the rotor is subjected to high centrifugal forces as the rotor 10 is rotated. Since the rotor body is made from a plastic material, the rotor body would normally deform due to centrifugal forces. A particularly novel feature of the rotor of the present invention is the inclusion of a rim 13 which has the shape of a right cylindrical tube. The internal cylindrical surface 23 abuts the peripheral surface 22 of the rotor body and prevents wall 20 from deforming outwardly under centrifugal forces generated when the rotor is rotated. Since rim 13 has the shape of a right cylindrical tube, the centrifugal forces acting on various segments of the cylindrical tube are equal, that is, there is no differential force imposed on different portions of the rim and the rim remains in place during the rotation of the rotor. The rim should be made of a material that maintains dimensional stability at very high speeds. It is preferred that the rim be made of aluminum or stainless steel.

The use of a non-metalic material, that is a plastic, for the manufacture of the body of the rotor reduces manufacturing costs, material costs, reduces weight of the rotor, and abates the need for fragile coatings on the surface of the fiber collect bowl. The plastic material from which the body of the rotor is made may be selected from any number of available self-lubricating plastics. Exemplary plastics include a lubricated acrylic plastic having a dry graphite (polysulfone) lubricant sold under the trademark DELRIN and lubricated nylon. The metal bushing 12 should be made of a material which is softer than the shaft on which it is to be mounted, and, preferably, the bushing is made from brass or bronze.

In the method of making the rotor, the body of the rotor is machined from a single piece of bar stock of plastic. Rim 13 must have the precise shape of a right cylindrical tube and can be precision machined from tube stock. Tube stock that has not been machined may be used if the tube stock has a precise right cylindrical shape. The rim 13 is positioned with respect to body of the rotor so that the internal surface 23 of the rim abuts the periphery 22 of the body. The rim is shrunk fit on the body by heating the rim and the body to an elevated temperature below the termperature where the plastic softens, generally, in the region of 200°–250° C. The body and the rim are allowed to cool so that the rim 13 shrinks and firmly engages the periphery 22 of the body. The bushing 12 is then press fit into elongated hole 16 and the peripheral surface of bushing 15 abuts the interior cylindrical surface provided by the cylindrical wall 15 of body 11.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A spinning rotor for use in an open end spinning device, the spinning rotor having a longitudinal axis about which it is rotated during use, the spinning rotor comprising:

a body, said body being comprised of a plastic material and including:

a first portion which defines receiving bowl, said bowl having an open first end which lies in a first plane transverse the longitudinal axis of the rotor, first ends of said body and first portion defining said first plane, said bowl being symmetrical with respect to the said rotor longitudinal axis, said body first portion having a cylindrical outer wall section which is coaxial with said rotor longitudinal axis, said cylindrical outer wall section extending from said first plane; and a second portion integral with said first portion, said second portion extending from the second end of said first portion and being symmetrical with respect to said rotor longitudinal axis, said second portion defining a cylindrical passage which extends between the second end of said bowl and the second end of said body, said passage being coaxial with the rotor longitudinal axis and having a diameter less than the diameter of said bowl first end;

a metal bushing positioned in said body second portion passage; and a metal rim circumscribing at least a portion of said body means first portion cylindrical outer wall section for reducing deformation of said rotor when the rotor is subjected to centrifical forces.

2. The spinning rotor of claim 1 wherein said body is comprised of a self-lubricating material.

3. The spinning rotor of claim 1 wherein said bowl diverges with respect to the rotor longitudinal axis at a first angle proceeding inwardly from said first end to a first point, said bowl diverging with respect to said axis at a second angle from said first point to a second point, said second angle being greater than said first angle, said bowl converging from said second point to the second end of said bowl.

4. The spinning rotor of claim 3 wherein said body is comprised of a self-lubricating material.

5. The spinning rotor of claim 4 wherein the length of said metal rim is equal to the length of the cylindrical outer wall section of said body first portion.

* * * * *